US006938770B2

(12) United States Patent
Nittono et al.

(10) Patent No.: US 6,938,770 B2
(45) Date of Patent: Sep. 6, 2005

(54) BLISTER PACK DISPLAY HOLDER

(75) Inventors: Shinji Nittono, Tokyo (JP); Taiji Yokota, Tokyo (JP)

(73) Assignee: FDK Corporation, Tokyo (JP)

( * ) Notice: Subject to any disclaimer, the term of this patent is extended or adjusted under 35 U.S.C. 154(b) by 20 days.

(21) Appl. No.: 10/402,735

(22) Filed: Mar. 28, 2003

(65) Prior Publication Data

US 2004/0004018 A1 Jan. 8, 2004

(30) Foreign Application Priority Data

Mar. 29, 2002 (JP) ..... 2002-096536

(51) Int. Cl.[7] ..... B65D 73/00
(52) U.S. Cl. ..... 206/485; 206/783
(58) Field of Search ..... 206/703, 705, 206/485, 476, 477, 482, 495, 784, 783, 775

(56) References Cited

U.S. PATENT DOCUMENTS 3,040,881 A * 6/1962 McNeill ..... 211/85.1
3,429,451 A * 2/1969 Samsing ..... 211/72
4,485,922 A * 12/1984 Desmond et al. ..... 206/485
5,199,578 A * 4/1993 Pendergraph et al. ..... 211/72
5,553,721 A * 9/1996 Gebka ..... 211/59.1
5,878,884 A * 3/1999 Mayled ..... 206/455

* cited by examiner

*Primary Examiner*—Derris H. Banks
*Assistant Examiner*—J Williams
(74) *Attorney, Agent, or Firm*—Harness, Dickey & Pierce, P.L.C.

(57) ABSTRACT

A blister pack display holder for holding a plurality of blister packs arranged vertically comprising a back plate adapted to be hung on a vertical structure, a frame with an open top end arranged adjacent to the back plate with a slight gap therebetween, wherein the back plate and right and left edges of the frame sandwich margins horizontally separated at sides of the blister pack respectively from the front and back so that the packs are slidably held vertically on a front surface of the back plate.

5 Claims, 10 Drawing Sheets

BLISTER PACK DISPLAY HOLDER

CROSS-REFERENCE TO RELATED APPLICATIONS

The present application claims priority upon Japanese Patent Application No. 2002-96536 filed on Mar. 29, 2002, which is herein incorporated by reference.

BACKGROUND Or THE INVENTION

1. Field of the Invention

The present invention relates to a blister pack display holder for holding a plurality of blister packs in an arranged state.

2. Description of the Related Art

Batteries are often seen on sale in stores in a state put in packages which is adapted to be hung. The package includes a mount and a cover for holding batteries therein, and the pack is called a "blister pack." FIG. 3 shows an external view of a blister pack for batteries as one example of a blister pack.

When selling the blister pack 20 in stores, multiple blister packs 20 are usually hung and displayed on a wall. In this case, a blister pack display holder as shown in FIG. 10 is typically used. This display holder if has a plurality of (upturned) hooks 15 on a front surface of a back plate 2, and the hook 15 of the display holder if is inserted in a hook hole 22 formed at an upper side of a board 21 of the blister pack 20 to hang the blister packs 20. A plurality of the blister packs 20 are usually hung on each hook 15.

However, with a conventional display holder, the long hook which projects forward from the back plate 2 is sometimes in the way in a narrow passageway in a store. The hook may get caught on clothes of a person walking through the passageway, and the blister packs which are hung may fall. Further, consumers are obstructed from seeing the products in the blister due to the hooks, and this could deteriorate the effect of sales promotion.

The blister packs are hung one by one on each hook when putting the blister packs on display, and this takes time and effort. Further, a plurality of blister packs are hung on the hook, and the pack may get caught on the hook shape at a tip of the hook, thus making it hard to take out the pack. If the blister pack is pulled excessively, the hook hole may tear. Meanwhile, the structure where a plurality of blister packs are hung on one hook is such that many blister packs may be taken out at once, although the hook holes may be broken. Thus, there is a possibility that a lot of packs may be stolen.

The distance between the respective hooks in a vertical direction is of course larger than a vertical length of the blister pack itself. Thus, not many blister packs may be arranged in a vertical direction, and the limited wall surface area is not effectively utilized. When attaching the display holder to a corner of a pillar or the like, both right and left ends of the board jut out of the pillar if the pillar is narrow, and may block the passageway causing danger. Of course, when the display packs are jutting out from the pillar, it is not desirable from an aesthetic point of view in a store interior.

SUMMARY OF THE INVENTION

One object of the present invention is to provide a blister pack display holder which may efficiently display multiple blister packs in a limited space. Another object of the present invention Is to provide a blister pack display holder which may flexibly match a width or shape of a vertical structure such as a wall surface.

In order to accomplish the above and other objects, one aspect of the present invention is a blister pack display holder for holding a plurality of blister packs arranged vertically comprising a back plate adapted to be hung on a vertical structure, a frame with an open top end arranged adjacent to the back plate with a slight gap therebetween, wherein the back plate and right and left edges of the frame sandwich margins horizontally separated at sides of the blister pack respectively from the front and back so that the packs are slidably held vertically on a front surface of the back plate.

Another aspect of the present invention is a blister pack display holder for holding a plurality of blister packs arranged vertically comprising a back plate adapted to be hung on a vertical structure, a plurality of slits arranged vertically, each of which defined as substantially a U-shape having approximately a same width as the blister pack, wherein each of the slits having left and right top ends of the U-shape rolled outwards to the right and left to form substantially an inverse U-shape, and a bottom portion of the U-shape remain uncut.

BRIEF DESCRIPTION OF THE DRAWINGS

For a more complete understanding of the present invention and the advantages thereof, reference is now made to the following description taken in conjunction with the accompanying drawings wherein.

DESCRIPTION OF THE PREFERRED EMBODIMENTS

At least the following matters will be made clear by the explanation in the present specification and the description of the accompanying drawings.

First Embodiment

Figure 1:
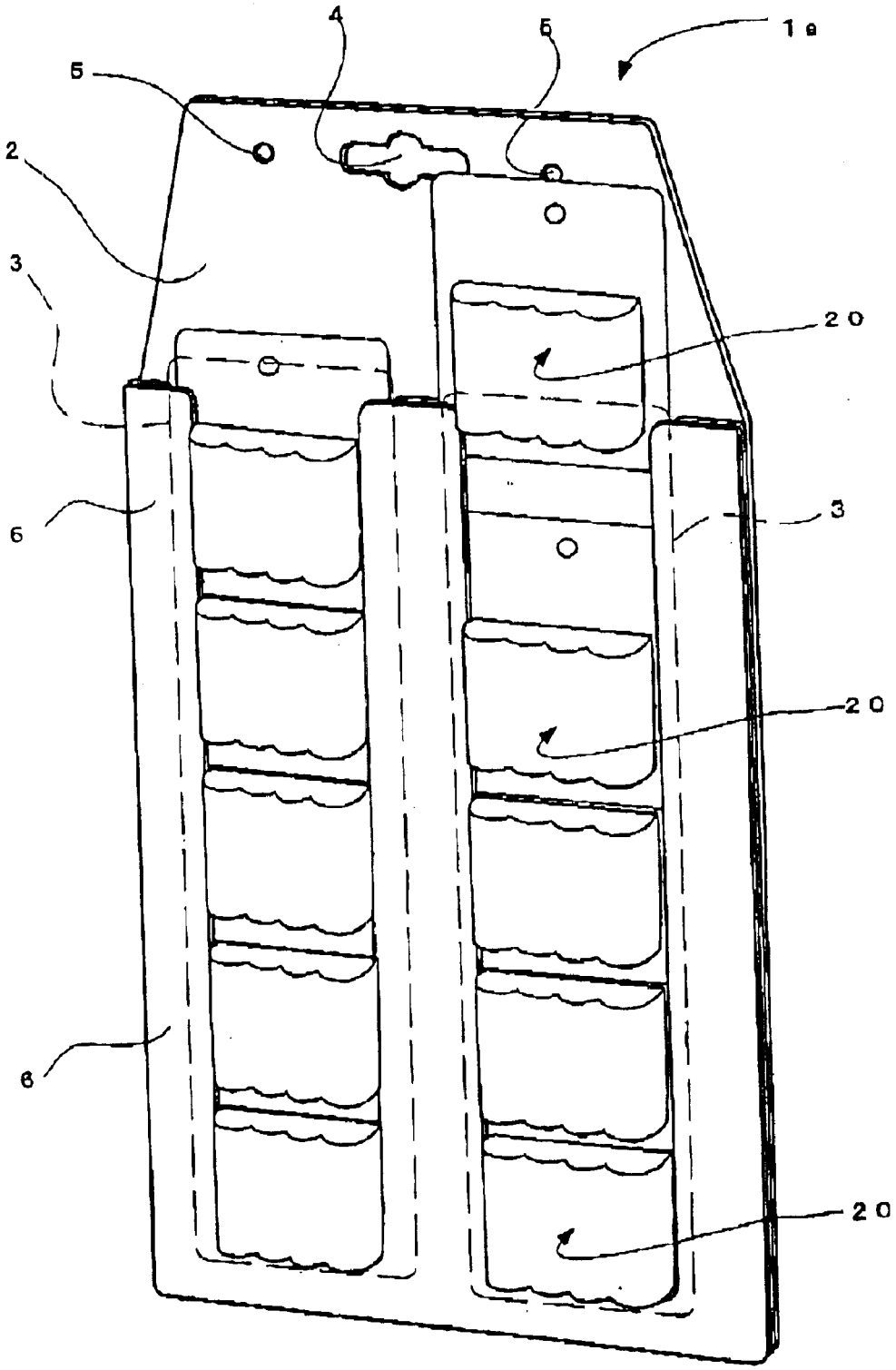
FIG. 1 shows an external view of a blister pack display holder in a first embodiment of the present invention.
Figure 2A:
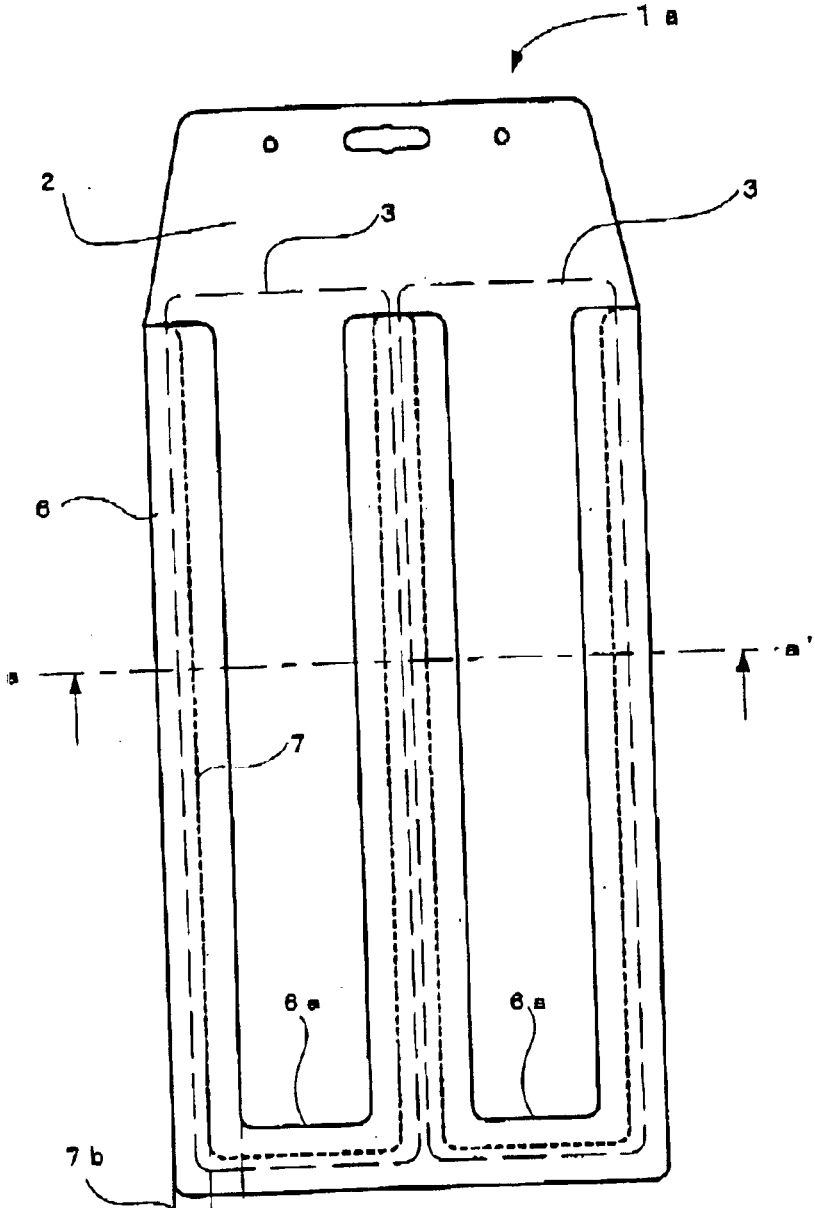
FIG. 2A shows a front view of the embodiment.
Figure 2B:
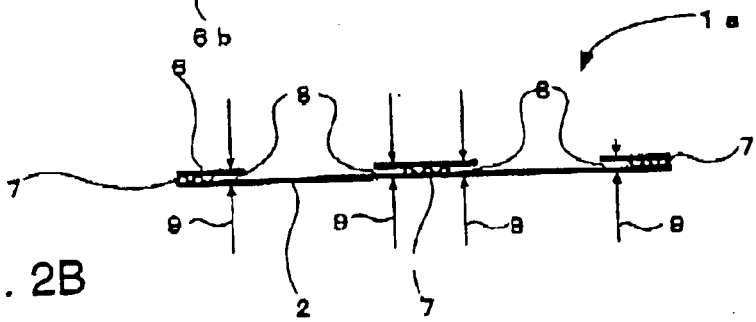
FIG. 2B shows a cross-sectional view of the embodiment.
Figure 3:
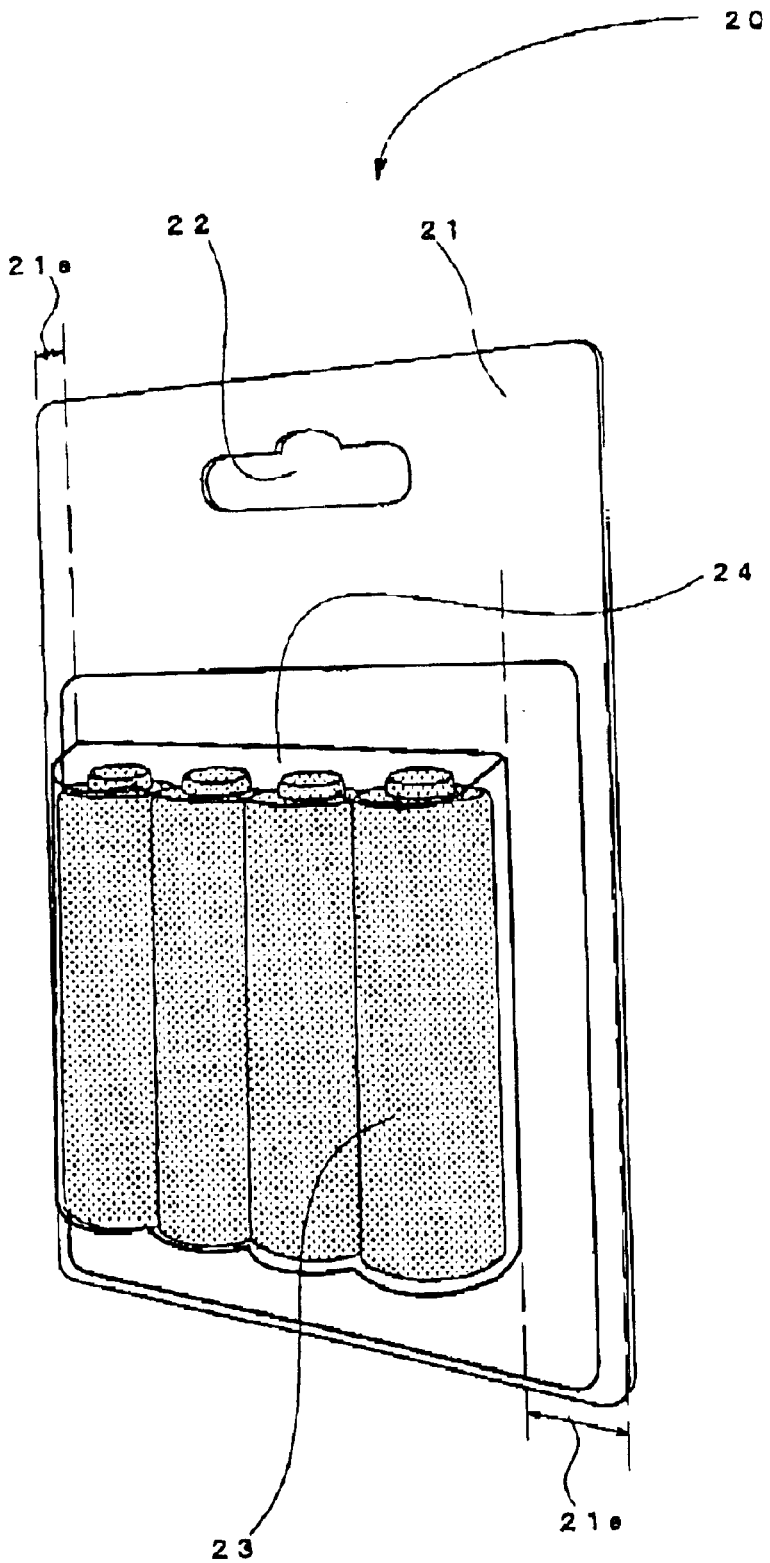
FIG. 3 shows a perspective view of a blister pack.

FIG. 1 is an external view of a display holder in a first embodiment of the present invention, and is shown holding and displaying blister packs 20 illustrated in FIG. 3. FIG. 2A and FIG. 2B show, a front view of a display holder 1*a*, and a cross-sectional view along line a–a' in the front view, respectively. This display holder 1*a* has a back plate 2 which is a sheet of cardboard (coated board: 600 g/mm) which comprises a holding portion 3 for holding the blister packs 20 arranged vertically on a front surface of the back plate 2. The holding portion 3 is able to hold five sets of blister packs 20 arranged vertically in a column, and in this example, the display holder has two columns of holding portions 3 side by side, so that a total of ten sets of the blister packs 20 may be held and displayed. Further, a hook hole 4 is formed at the top of the back plate 2, and eyelets 5 are disposed at both right and left sides of the hook hole 4. Thus, the (upward) hook provided on a wall is directly inserted in the hook hole 4 to hang the display holder 1*a*, or a string is passed through the eyelets 5 and then hung on the (upward) hook, so that various hanging modes may be employed.

The holding portion 3 is generally a frame with an open end at the top, and the right and left inner edges of this frame and the back plate are formed to slidably hold right and left margins 21*a* of the board 21 of the blister pack 20. Specifically, a cardboard (frame) 6 shaped as two frames that are open at the top arranged side by side is opposed to a back plate 3 with a corrugated paper 7 in between, and the width 7*b* of the corrugated board 7 is made narrower than the edge portion 6*b* of the frame of the back plate 6 to form grooves 8 which open towards the inside of the frame. Then, the right and left edges of the blister pack 20 are made to move along grooves 8 at the right and left side of the holding portion 3, to insert the pack into the holding portion 3. The protrusion of the blister 24 is made to contact a lower end 6*a* of the frame to prevent the blister pack 20 from falling. Of course, the upper edge as well as the lower edge of the frame may be opened to form the holder with the two opposing grooves on the right and left. Then, the lower ends of the groove are closed, and the lower ends of the right and left margins of the board of the blister pack are supported at the lower ends of the grooves to prevent the blister packs from falling. Further, the holder may be formed not only with a structure where the frame opposes the back plate, but for example, with the right and left sides of the back plate folded to the front to thereby form grooves that oppose each other.

Figure 4:
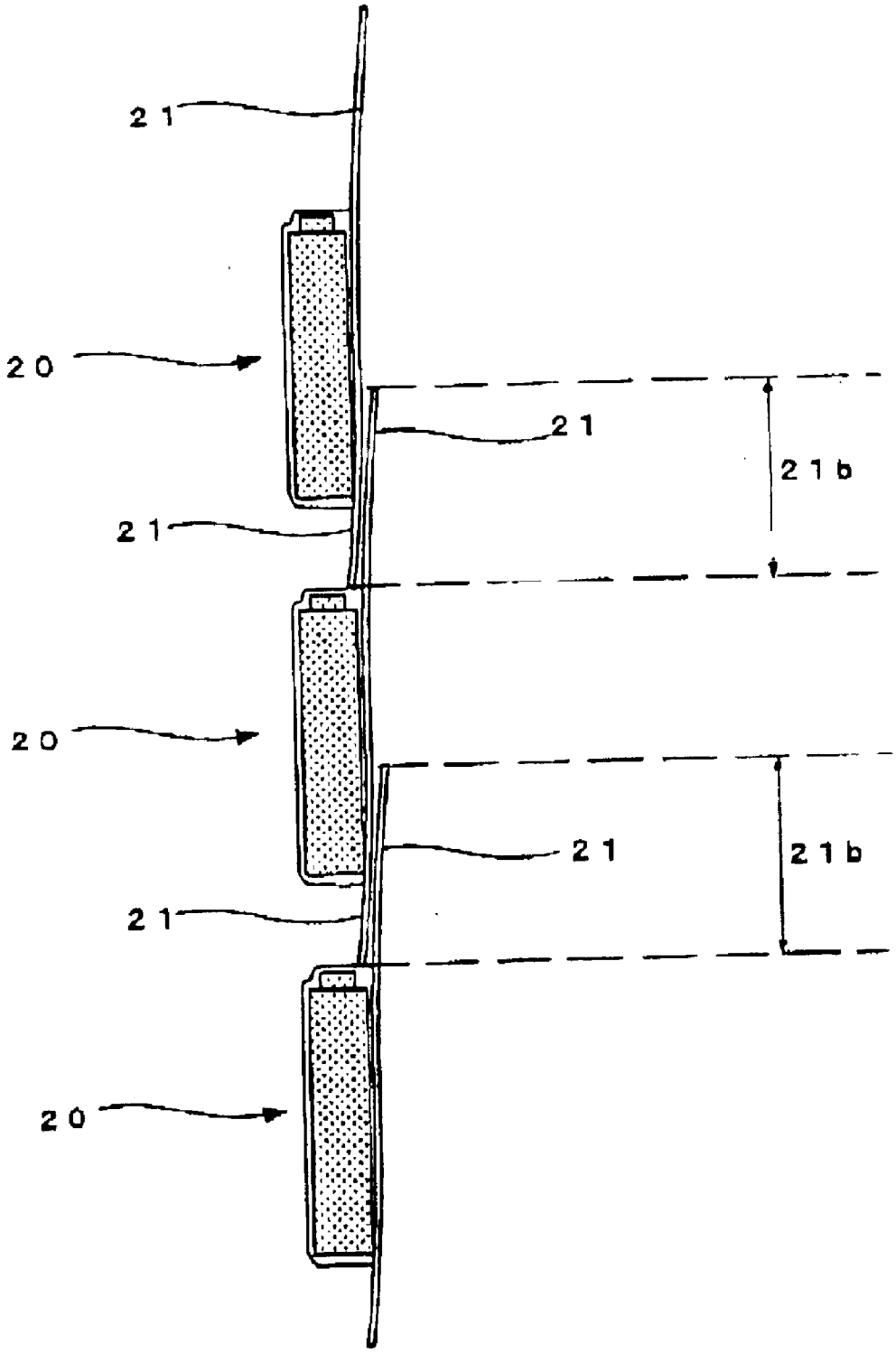
FIG. 4 shows a schematic view of the display holder of the first embodiment holding the blister packs.

Note that in this embodiment, a width 9 of the groove 8 is wider than the thickness of two boards of the blister pack, and in a state a plurality of blister packs 20 are inserted in the holding portion 3, the boards 21 of the blister packs 20 at the top and bottom are made to partially overlap each other. Therefore, a total length of the plurality of blister packs 20 when arranged vertically becomes shorter than a length of the vertical length of each pack 20 multiplied by the number of blister packs 20. FIG. 4 is a schematic diagram showing a state where the blister packs 20 are overlappingly held. The lower end of the upper blister pack 20 contacts the upper end of a blister 24 or the lower pack 20, thereby shortening a length 21*b* from the top end of the board 21 of the blister pack 20 to the top end of the blister 24.

Modified Embodiment: Mechanism for Taking Out Pack

Figure 5:
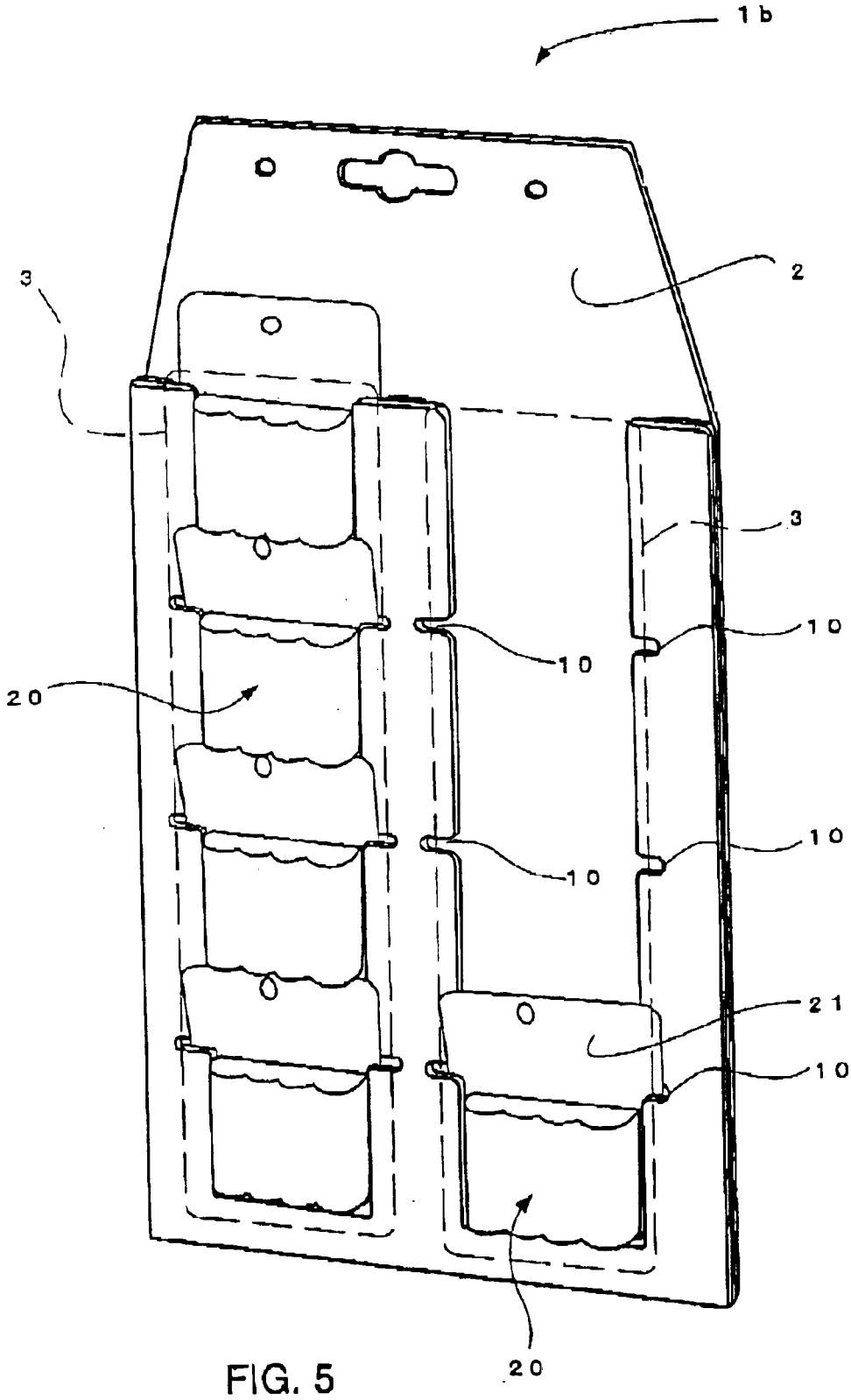
FIG. 5 shows an external view of a modified example of the first embodiment.

In the first embodiment, blister packs 20 are slid along grooves 8 one by one and inserted into a holding portion 3. Thus, the blister packs 20 are slid one by one and taken out. A mode where an arbitrary one of the packs 20 may be taken out from the plurality of blister packs 20 which are arranged vertically and inserted in the holding portion 3 is shown as a modified embodiment. FIG. 5 shows an external view of an outline of the modified embodiment. In this embodiment, notches 10 are defined on the inner edges of the grooves 8 symmetrically, and the upper end of the board 21 of the blister pack 20 held in the holding portion 3 is exposed outside at a front surface of the holding portion 3 through the notches 10. Thus, if the exposed upper end of the board 21 is grasped and pulled upwards, any blister pack 20 held in the holding portion 3 may be taken out. Of course, when inserting the blister pack 20 in the holding portion 3, the pack is slid downwardly along the grooves 8 from the notches 10.

Second Embodiment

Figure 6:
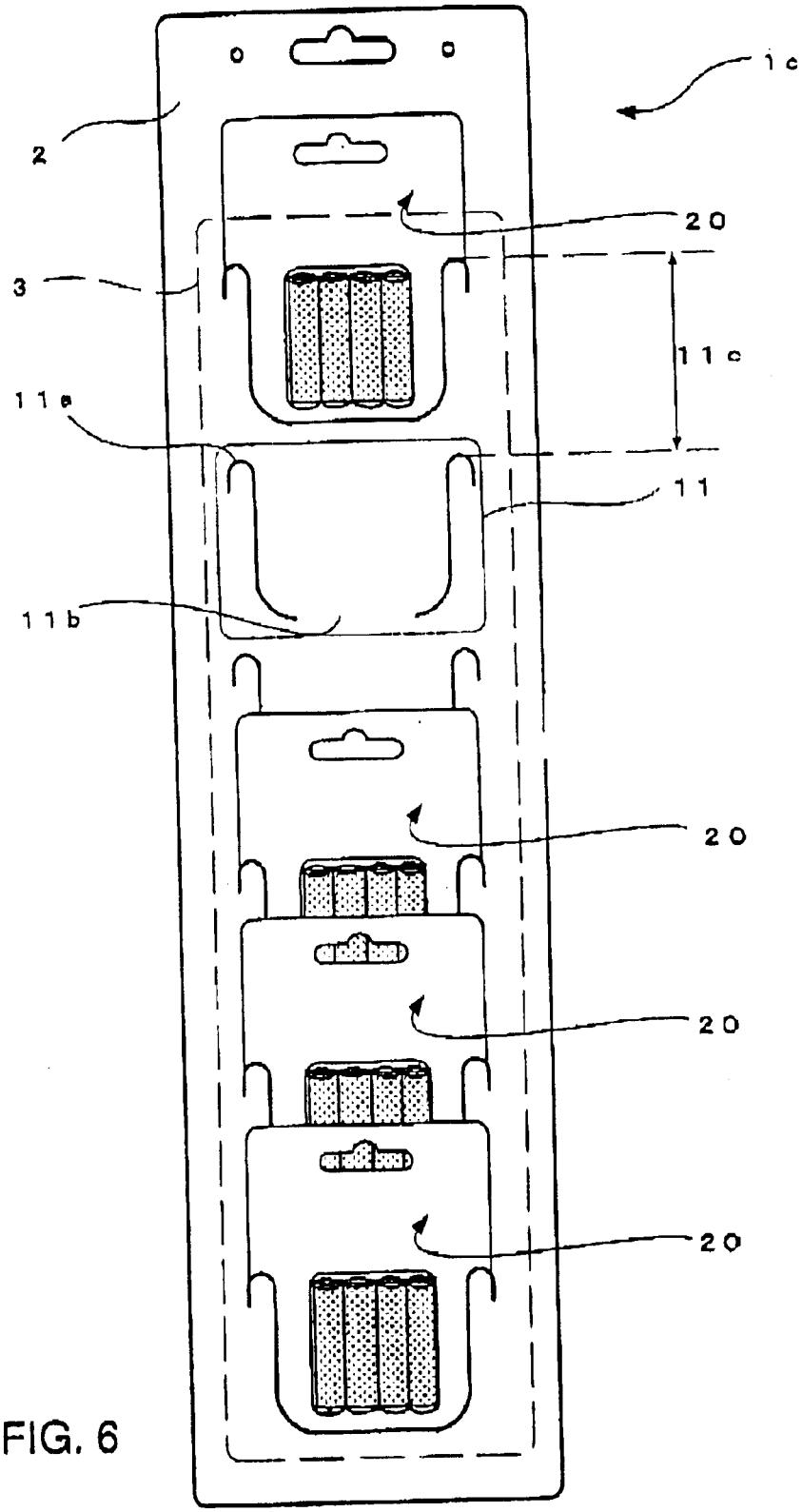
FIG. 6 shows an external view of a blister pack display holder according to a second embodiment of the present invention.
Figure 7:
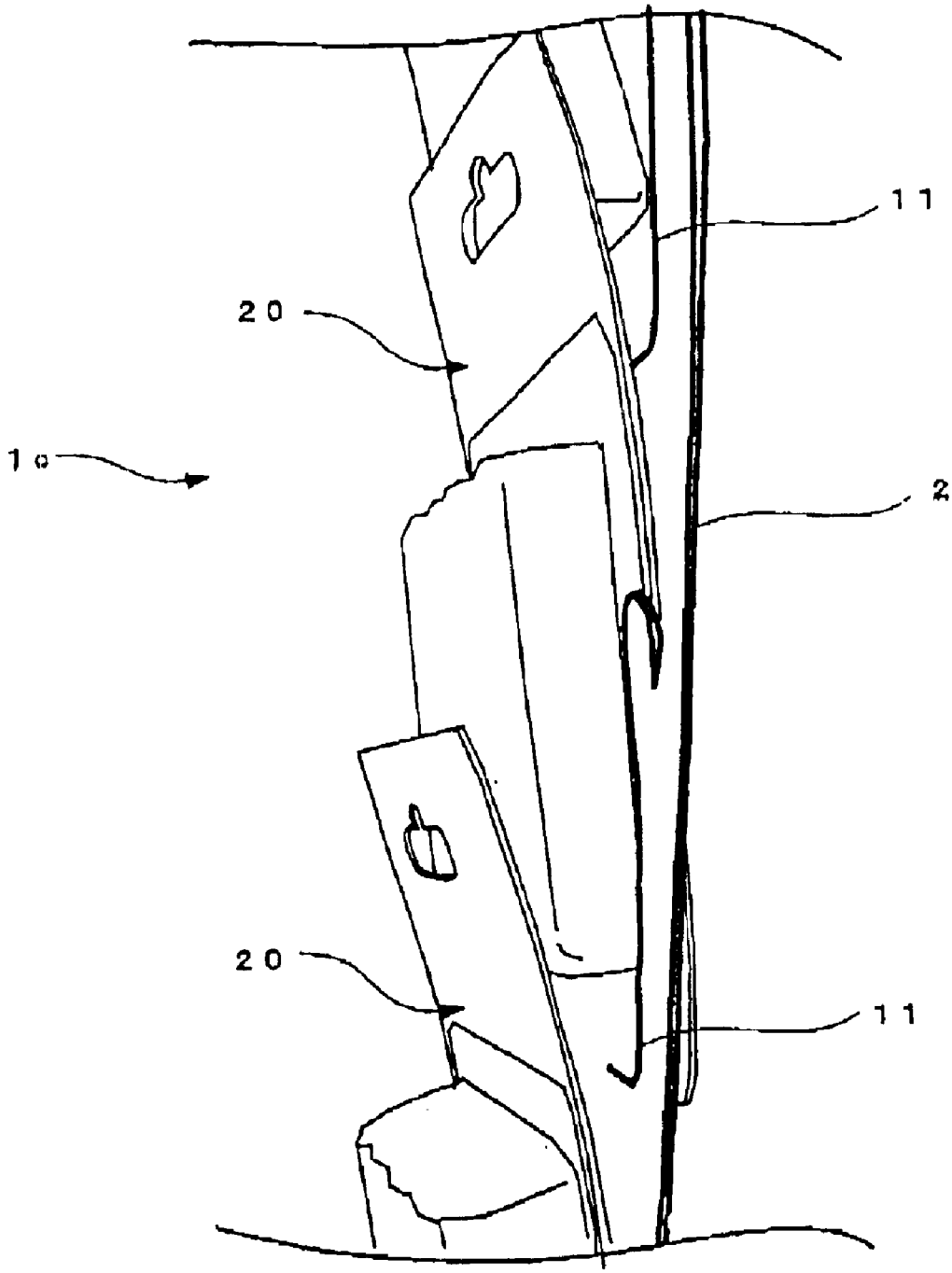
FIG. 7 shows a schematic view of the display holder of the second embodiment holding the blister packs.

FIG. 6 shows an external front view of a display holder in a second embodiment of the present invention. In this example, the display holder 1*c* comprises substantially U-shaped slits 11 which are approximately equal to a width of a blister pack 20 arranged in a vertical direction in one column to form a holding portion 3. A portion 11*b* at the bottom of the U shape of each notch is not slit but connected, and both upper ends 11*a* of the U-shape fold back to form an inverse U-shape.

Further, in the display holder 1*c*, a distance 11*c* from the top to the bottom of each U-shaped slit 11 is shorter than the vertical length of the blister pack 20, and when the right and left margins 21*a* of the board 21 of the blister pack 20 are inserted in each slit 11, the blister packs 20 are displayed overlapping each other at the top and bottom, and thus the total length of the back plate 2 is shortened as similar to the first embodiment. Further, the upper end or the blister pack 20 is slanted forward from a front surface of the back plate 2, so that each blister pack 20 may be easily taken out. FIG. 5 shows an enlarged view of the state of holding the blister packs 20.

Applied Embodiment

In a conventional display holder, blister packs and the display holder therefor are separately transported. The display holder is hung on a wall in stores, and thereafter the blister packs are individually hung on hooks of this holder and displayed. However, the display holder of the present invention can be transported in a state the blister packs are inserted in the holding portion. Namely, if the present invention is applied during transportation of the blister packs, the blister packs may be shipped in a state fitted in the display holder. Then, the delivered display holders just need to be hung in order to complete the displaying operation of the blister packs in stores. Thus, the display holder of the present invention may decrease the cost related to the display work. Further, since the blister packs are carried in a state arranged on a plane, they are packed thin and not bulky, so that an effect of decreasing the transportation costs is expected.

Other Embodiments

Figure 8:
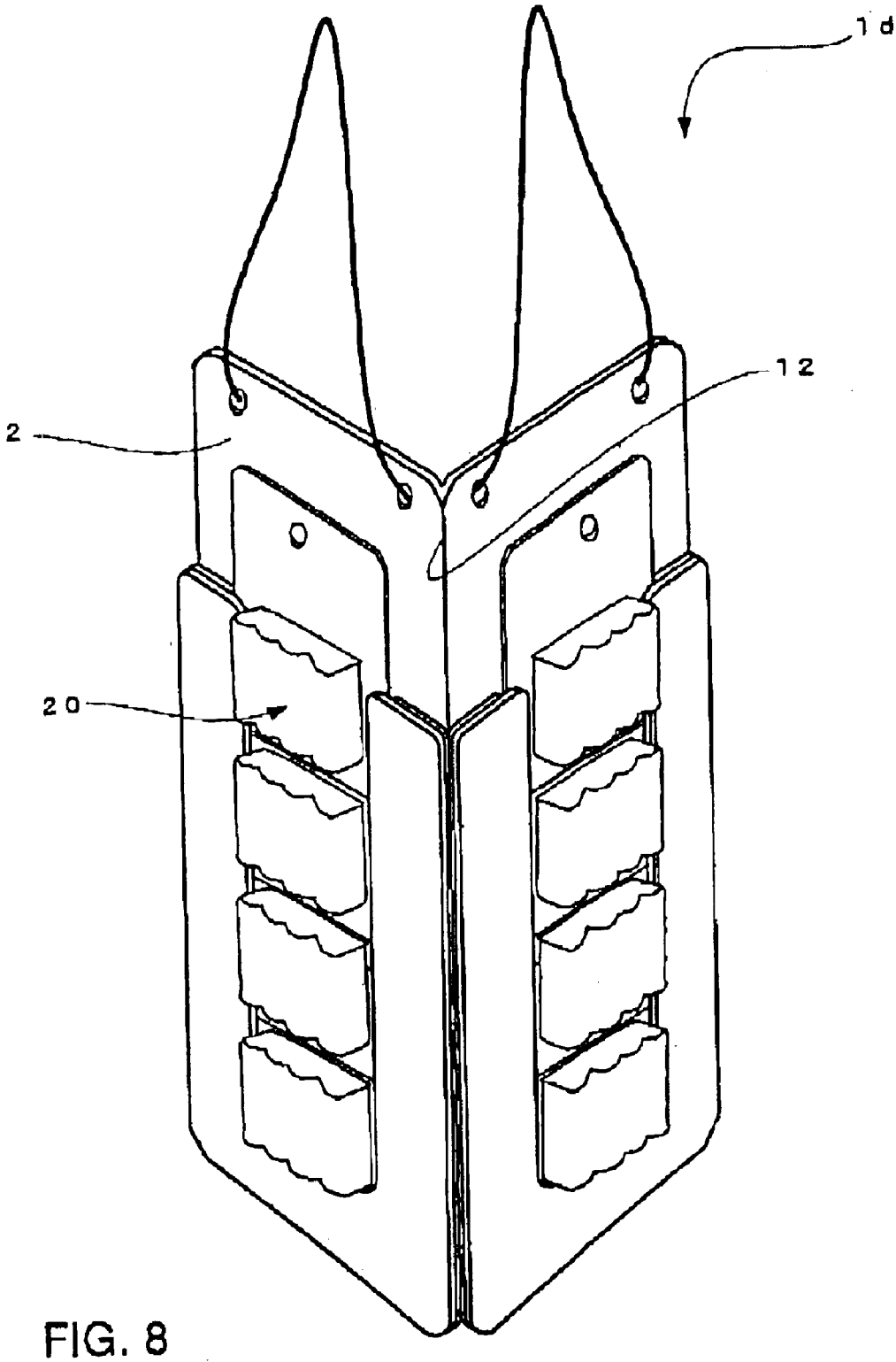
FIG. 8 shown an external view of a blister pack display holder with a fold line in a back plate according to another embodiment of the present invention.

In a display holder having a plurality of columns of holding portions, a fold line is defined between a pair of holding portions of a back plate. If the back plate is folded along the fold line, the blister packs may be displayed along a corner of a pillar or the like. In this way the blister packs 20 may be displayed along a corner contour of the pillar, and the back plate 2 does not jut out from either side of the pillar, and thus safety is secured. Further, it is also esthetically beautiful. FIG. 8 shows an external view of an example display holder 1*d* with the fold line. Note that, the fold line 12 may be appropriately defined by a ruled line with thinned thickness, a tear-oft line, and the like.

Figure 9:
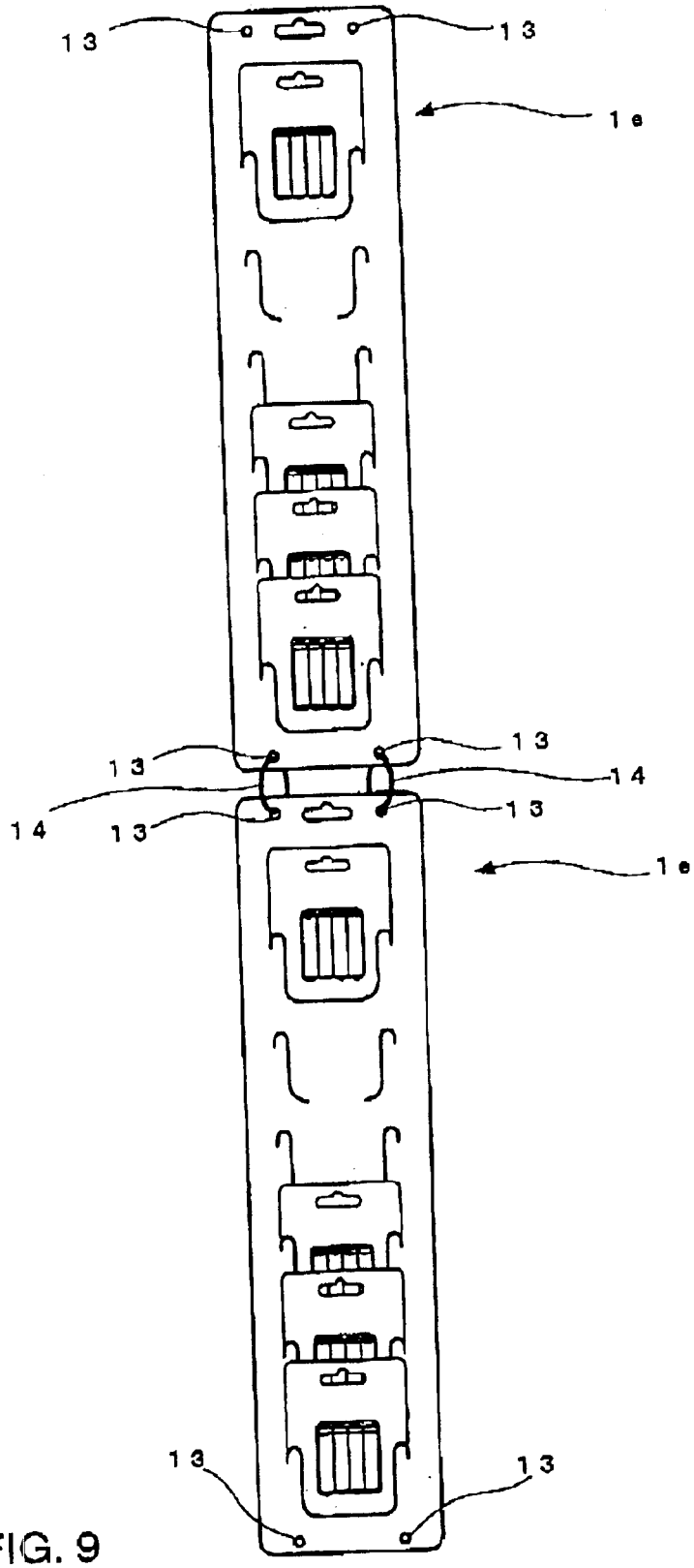
FIG. 9 shows an external view of a blister pack display holder which is vertically connectable according to further embodiment of the present invention.
Figure 10:
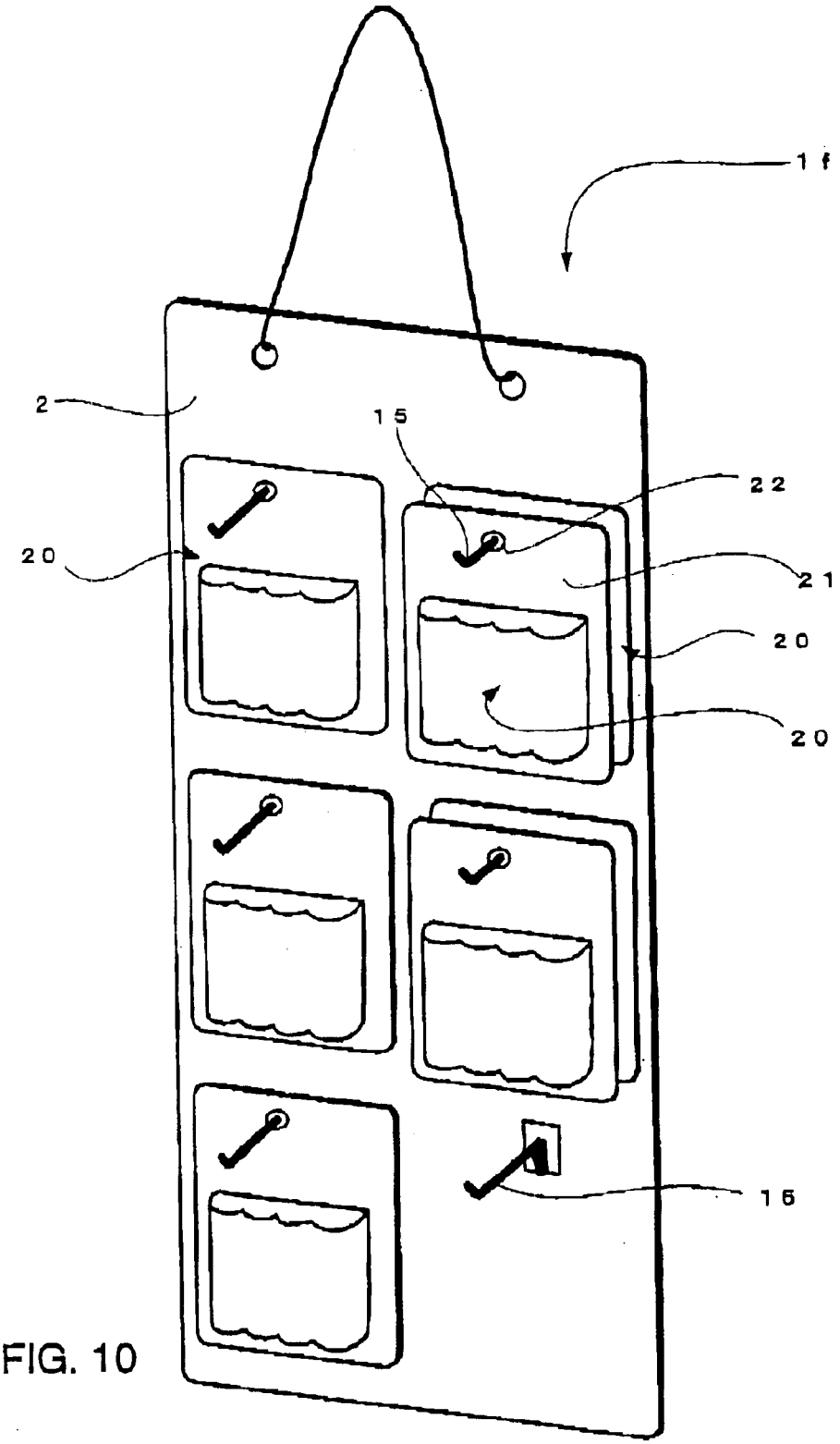
FIG. 10 shows an external view of a conventional blister pack display holder.

In the case more blister packs 20 are to be displayed in a vertical direction, if the back plate is elongated, it becomes too bulky for transportation. Further, the back plate tends to bend. The back plate may have an appropriate connector for connecting it to another display holder. FIG. 9 shows an external view of a display holder 1*e* as an example which may be connected vertically. In this example, eyelets 13 are provided to the upper and lower ends of the back plate 2 respectively, and metal rings or strings 14 are passed through the eyelets 13 to connect the back plates 2 at the top and bottom to each other. Of course, the mechanism is not limited to the eyelets 13, the rings 14, and the like which indirectly connect the back plates 2 together, but for example, may be a mechanism such as snaps which directly attach the back plates at the top and bottom together.

Note that the display holder is not limited to a cardboard, and the material is appropriately selectable as plastic, metal, or the like.

According to a blister pack display holder of the present invention, the blister packs may be partially overlapped and displayed in a vertical direction without requiring a part which protrudes forward such as a hook. Therefore, multiple blister packs may be efficiently displayed in a limited space.

Since the blister packs are held by the right and left margins of the board thereof, the displaying work load is reduced, the blister packs may be easily taken out, the displaying form is such that only the protrusions of the blisters protrude forwards, and the products in the blisters gain attention, thus contributing to sales promotion.

Further, the mechanism is such that the blister packs are taken out one by one so that all the displayed blister packs may not be quickly taken at once, and thus effect of theft prevention is expected.

Although the preferred embodiment of the present invention has been described in detail, it should be understood that various changes, substitutions and alterations can be made therein without departing from spirit and scope of the inventions as defined by the appended claims.

What is claimed is:

1. A blister pack display holder for holding a plurality of blister packs comprising:

a back plate adapted to be hung vertically; and plural sets of slits formed through said back plate and arranged vertically, each set of slits having a pair of slits opposed each other with a spacing therebetween and defining a generally U-shape configuration with a bottom portion thereof being uncut, each slit of said pair having a top end curved outwards;

wherein said blister packs are hung on said holder in such a manner that right and left lower margins of each blister pack be inserted into back sides of said curved top ends of said paired slits.

2. A blister pack display holder for holding a plurality of blister packs as claimed in claim 1 wherein said curved top end of each of said paired slits is in the shape of an inverse U-shape.

3. A blister pack display holder for holding a plurality of blister packs as claimed in claim 1 or 2 wherein said plural sets of said slits are vertically separated with a spacing which is less than a vertical length of said blister pack.

4. A blister pack display holder for holding a plurality of blister packs as claimed in claim 1 or 2 wherein said plural sets of said slits are formed in the vertical direction and horizontal direction through said back plate and a vertical folding line is formed between said horizontally adjacent plural sets of slits.

5. A blister pack display holder for holding a plurality of blister packs as claimed in claim 1 or 2 wherein said back plate further comprising a connecting mechanism for connecting another back plate in a vertical direction.

* * * * *